US006332772B2

(12) United States Patent
Sung

(10) Patent No.: US 6,332,772 B2
(45) **Date of Patent: *Dec. 25, 2001**

(54) CHILD-RESISTANT UTILITY LIGHTER INCORPORATING A CAM MECHANISM AND A LEVER SPRING LOCK

(75) Inventor: Kil Yong Sung, Fullerton, CA (US)

(73) Assignee: Calico Brands, Inc., Ontario, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/751,628

(22) Filed: Dec. 30, 2000

Related U.S. Application Data

(63) Continuation of application No. 09/531,082, filed on Mar. 18, 2000, now Pat. No. 6,168,420, which is a continuation-in-part of application No. 09/507,100, filed on Feb. 17, 2000, now Pat. No. 6,186,773.

(60) Provisional application No. 60/126,326, filed on Mar. 26, 1999.

(51) Int. Cl.[7] ..... F23D 11/36

(52) U.S. Cl. ..... 431/153; 431/255; 431/344

(58) Field of Search ..... 431/153, 255, 431/344, 345, 277; D27/141; D7/416; 126/405, 406, 407; 251/77, 353

(56) References Cited

U.S. PATENT DOCUMENTS

| | | |
|---|---|---|
| 3,493,313 | 2/1970 | Schlamp . |
| 3,719,447 | 3/1973 | Dessoy . |
| 4,502,465 | 3/1985 | Yoshinaga . |
| 4,538,983 | 9/1985 | Zeller . |
| 4,832,596 | 5/1989 | Morris, Sr. . |
| 4,859,172 | 8/1989 | Nitta . |
| 5,199,865 | 4/1993 | Liang . |
| 5,236,351 | 8/1993 | Tien . |
| 5,322,433 | 6/1994 | Shike . |
| 5,326,256 | 7/1994 | Shike . |
| 5,348,467 | 9/1994 | Piffath . |
| 5,401,163 | 3/1995 | Yamazaki . |
| 5,412,179 | 5/1995 | Chen . |
| 5,417,571 | 5/1995 | Kvalseth . |
| 5,451,159 | 9/1995 | Kim . |
| 5,454,713 | 10/1995 | Lee . |
| 5,460,521 | 10/1995 | Tsai . |

(List continued on next page.)

FOREIGN PATENT DOCUMENTS

| | | |
|---|---|---|
| WO 99/47855 | 9/1999 | (WO) . |
| WO 99/60309 | 11/1999 | (WO) . |

*Primary Examiner*—James C. Yeung
(74) *Attorney, Agent, or Firm*—Trojan Law Offices

(57) ABSTRACT

A safety mechanism of a utility lighter. In a first preferred embodiment, the safety mechanism includes a safety button and a cam mechanism having a fuel release lever, a cam lever, and a return spring. When the cam mechanism is in the locked position, the cam lever engages the stopper tab of the trigger to impede depression of the trigger, and the fuel release lever closes the fuel release valve. The cam mechanism is actuated by depressing the safety button. As the safety button is depressed, the cam lever is disengaged out of alignment with the stopper tab to permit depression of the trigger, the hub rotates, and the fuel release lever is actuated to open the fuel-release valve. As the safety button is released, the return spring urges the cam mechanism into the locked position. In a second preferred embodiment, the safety mechanism includes a lever spring and the cam mechanism having the fuel release lever and the safety button. When the cam mechanism is in the locked position, the lever spring engages the stopper tab to impede depression of the trigger, and the fuel release lever closes the fuel release valve. The cam mechanism is actuated by depressing the safety button. As the safety button is depressed, the lever spring is disengaged out of alignment with the stopper tab to permit depression of the trigger, the hub rotates, and the fuel release lever is actuated to open the fuel-release valve. As the safety button is released, the lever spring urges the cam mechanism into the locked position.

6 Claims, 1 Drawing Sheet

U.S. PATENT DOCUMENTS

| | | | | |
|---|---|---|---|---|
| 5,492,468 | | 2/1996 | Cirami . | |
| 5,496,169 | | 3/1996 | Chen . | |
| 5,531,592 | | 7/1996 | Tasi . | |
| 5,545,035 | | 8/1996 | Tsai . | |
| 5,655,901 | | 8/1997 | Makoto . | |
| 5,697,775 | | 12/1997 | Saito . | |
| 5,738,507 | | 4/1998 | Mifune . | |
| 5,771,880 | | 6/1998 | Tsai . | |
| 5,934,895 | | 8/1999 | McDonough . | |
| 5,967,768 | | 10/1999 | Saito . | |
| 5,980,242 | | 11/1999 | Man . | |
| 6,010,328 | | 1/2000 | Sung . | |
| 6,012,916 | | 1/2000 | Liang . | |
| 6,022,212 | | 2/2000 | Saito . | |
| 6,042,367 | | 3/2000 | Saito . | |
| 6,050,810 | | 4/2000 | Huang . | |
| 6,059,563 | | 5/2000 | Hsu . | |
| 6,065,958 | | 5/2000 | Adams . | |
| 6,168,420 | * | 1/2001 | Sung | 431/344 |
| 6,168,423 | | 1/2001 | Man . | |
| 6,186,773 | * | 2/2001 | Sung | 431/153 |

* cited by examiner

CHILD-RESISTANT UTILITY LIGHTER INCORPORATING A CAM MECHANISM AND A LEVER SPRING LOCK

RELATED PATENT APPLICATIONS

This application is a continuation of Ser. No. 09/531,082, filed Mar. 18, 2000, now U.S. Pat. No. 6,168,420, issued Jan. 2, 2001, which is a Continuation-in-Part of Ser. No. 09/507,100, filed Feb. 17, 2000, now U.S. Pat. No. 6,186,773, issued Feb. 13, 2001, which claims the benefit of U.S. Provisional Application No. 60/126,326, filed Mar. 26, 1999.

BACKGROUND OF INVENTION

1. Field of the Invention

This invention relates to a utility lighter which contains a safety feature incorporating a cam mechanism and a safety button, wherein normal operation of the lighter through depression of the trigger is impeded by the safety feature, and wherein operation of both the safety button and the trigger will produce a flame.

2. Background Art

Utility lighters are very useful and have become quite prevalent in modern times. Utility lighters of the type described herein generally contain a handle and an elongated lighting rod. The shape and operation of utility lighters allow for several advantages over normal means of producing a flame. Most significantly, due to the elongated nature of the lighting rod, utility lighters enable the operator to stand a safe distance away from the object to be ignited before actuating the lighter, thus avoiding a large number of potential accidents. In addition, utility lighters allow a flame to be produced in hard-to-reach or narrow places, where the human hand holding a match would not normally fit. Still, in the hands of children, or others who do not know how to safely and properly operate the lighter, such lighters are as dangerous as any other spark and/or flame-producing device. Therefore, a need has been realized to equip utility lighters with safety features that minimize accidental or improper use by inexperienced persons, especially young children.

Many inventions have been created to address this safety-related concern. Generally, these inventions have sought to introduce safety mechanisms that disable automatic operation of either the spark-generation and/or the fuel-release function of the lighter. For example, some utility lighters provide for a blocking mechanism, where the actuating trigger is blocked from moving the required distance for a spark to be generated. In these lighters, the locking mechanism is normally de-activated by sliding an "on/off" switch to the "on" position, or by other means, so as to remove the impediment from the actuating trigger's operating path.

Although utility lighters of the type described above provide some level of safety, there is much room for improvement. Specifically, in these lighters, once the locking means (e.g., the on/off switch) is disabled, the lighter remains in the unlocked state until the locking mechanism is activated again. Therefore, if the operator disables the locking mechanism in order to use the lighter, and then forgets to re-lock the lighter, the safety feature of the lighter is rendered useless, until the locking mechanism is again activated.

Other inventions have attempted to address the safety-related issues by impeding not the operation of the trigger, but that of the fuel-release mechanism. Of course, a utility lighter containing such a mechanism would inhibit flame generation in the locked position as no fuel would be released until the locking mechanism has been deactivated. However, in these types of lighters, nothing prevents a spark from being generated. As such, the safety goals are only partially met in these types of lighters since young children handling the lighter could still create fires by operating the lighter in close proximity to a source of fuel or near carpets, paper, or other flammable material.

In order to address the above problems, some inventions have introduced locking mechanisms that are activated automatically after each use of the lighter. As such, in these lighters, two states of operation exist: the locked state and the operable state. In the locked state, neither a spark nor a flame can be generated. In contrast, in the operable state, the lighter is no longer locked, so that a flame can be generated. Although, in general, this improvement has alleviated some of the concerns mentioned above, there is still room for further improvement. Specifically, in most dual-state, automatic-locking lighters, once the lighter is unlocked and the trigger activated, the flame that is generated will subsist for as long as the trigger is held in the depressed position. In other words, once the locking mechanism is disabled, flame generation is a simple task involving depression of the trigger. This is of some concern since even young children might be able to achieve this task.

Therefore, there is a need for a device that not only achieves the stated safety goals in generating a flame, but also makes it difficult for inexperienced users and/or young children to sustain the flame. The invention described herein offers such a combination. The invention requires that a safety button, protruding generally from the top portion of the lighter housing shell, be depressed simultaneously with a trigger before a flame can be produced. In addition, the invention requires that the safety button, and not necessarily the trigger, be held in its activated state in order for the flame to be sustained; releasing the safety button after simultaneous activation of both the safety button and the trigger will cause the flame to be extinguished.

The unique structure of the cam mechanism contained in the present invention provides for an optimum amount of safety as it makes it very difficult, if not impossible, for young children to operate the device. Young children are capable of carrying out only simple mental concepts. As such, a young child wishing to operate the present invention would attempt do so in the usual way, i.e., by pressing the trigger. However, due to the automatic locking mechanism of the device, the trigger will not move. This alone will act as a deterrent as most young children will simply abandon the device after several unsuccessful attempts. This is true because a child operator must first recognize that both the trigger and the safety button must be operated simultaneously before a flame can be generated. This is generally too convoluted a concept for young children to grasp or appreciate.

Nevertheless, even if a young child were to be able to learn the proper operation of the device, he or she would probably still be unable to actually operate the device. Given the relative location of the trigger and the safety button, operation of the present invention requires that the user be able to grasp the handle of the lighter in his or her hand, operate the trigger with the index finger, and simultaneously operate the safety button with the thumb. This, in turn, requires not only a significant amount of manual dexterity, but also hands that are sufficiently large, namely, adult hands. Moreover, successful operation of the device requires an amount of strength and pulp that are rarely found in the fingers of young children.

In addition, even if a child were to posses the mental capacity for understanding and learning the required process of operation, a large enough hand, and the required amount of manual dexterity, strength, and pulp, so that he or she could somehow generate a flame, he or she would have to recognize a second concept: that the flame will not be sustained unless the safety button is held in its activated state. Again, this is a difficult mental concept for a child to recognize and learn. Moreover, even if learned, the concept would be difficult for a child to operationalize given the above discussion regarding the mental and physical limitations of young children. On the other hand, an adult user would have no difficulty operating the invention as the device requires no more than the simultaneous operation of two strategically positioned buttons.

In addition to all of the safety advantages described above, the invention described herein offers a significant reduction in cost, and a significant increase in ease, of manufacturing. The cam mechanism is an integrated, one-piece member that can perform the functions of two (2) or three (3) separate members in most other utility lighters currently available on the market. Moreover, the entire safety feature, as well as full operation of the device is generally enabled by the manufacture and use in the lighter of two (2) basic elements: the cam mechanism and the safety button. In addition, it is contemplated that these two elements may even be combined, so that only one integrated structural member need be produced. This, of course, would lead to even more significant savings and simplicity in the manufacturing process.

SUMMARY OF THE INVENTION

The primary object of this invention is to provide a safety mechanism for utility lighters so that children or inexperienced users will be less likely to inadvertently activate the lighter. Such a safety feature is especially important because young children often play with lighters as toys and because lighters have mechanically moveable parts that make them attractive to children as toys.

Another object of the present invention is to prevent the generation of not only a flame, but even a spark. As noted previously, in a lighter where only the fuel-release mechanism is inhibited in the locked state, young children playing with the lighter can still use the lighter to create sparks. Depending on the child's surroundings, this can lead to the start of accidental fires if the child is operating the lighter near paper products or any other source of flammable material.

A further object of the invention described herein is to provide an improved device for maximizing safety in utility lighters without compromising ease of use. To this end, the addition of a safety button creates a simple additional step which, for the intended user, leaves the operation of the utility lighter as simple as it has always been to operate a regular utility lighter with no safety feature, yet, creates an additional mental step which acts as a deterrent for non-intended users.

Another object of this invention is to reduce the risk of unintended fires, especially by young children, by making it impossible for the flame to continue to burn unless two (2) separate functions are performed simultaneously and operation of a safety button is continued without interruption.

A final object of the present invention is to meet all of its safety goals while, at the same time, it maximizes ease of manufacturing and minimizes costs associated with manufacturing of parts.

The invention meets its objectives by providing a cam mechanism that integrates several structural elements. In a first preferred embodiment, the cam mechanism consists of a cam lever, a fuel-release lever, and a return spring. Most significantly from a safety standpoint, the cam mechanism contains a cam lever that acts to lock the trigger in the inoperative position.

In a second preferred embodiment, the safety mechanism consists of a cam mechanism and a lever spring. The cam mechanism consists of a fuel-release lever and a safety button. The lever spring locks the trigger in the inoperative position.

Typically, a young child will attempt to activate the lighter by depressing the trigger only. However, when this is done, the trigger will not move at all or significantly, so that neither a spark nor a flame will be generated. Since the trigger is locked in this position, repeated operation of the trigger by a child will yield the same unsuccessful results.

The only way to activate the lighter is to depress the safety button. In the first preferred embodiment, depressing the safety button moves the cam lever out of the path of the trigger, so that the trigger can now be depressed. In the second preferred embodiment, depressing the safety button moves the lever spring out of the path of the trigger, so that the trigger can now be depressed.

Depression of the safety button also causes the fuel-release lever to move, so that, depending on the extent of pressure placed on the safety button, the fuel-release valve may be opened and fuel released. As such, a second significant safety-related feature of the present invention is that a small amount of pressure on the safety button will release the trigger lock. However, such pressure will not release sufficient fuel for a flame to be produced. That is, the most that can happen when the user presses the safety button slightly, and then depresses the trigger, is that a spark would be generated. To ignite the spark, the user would have to continue pressing the safety button further than is required to release the lock, so that sufficient fuel is released before the trigger is activated and a spark and flame are generated.

The above procedure ensures that even if a child were to be able to momentarily press the safety button to release the lock, he or she would still have trouble creating a flame, as doing so would require further pressure on the safety button. This is a simple, yet effective concept. Nevertheless, it is a concept that a young child operating the lighter must recognize and grasp before he or she can successfully operate the lighter. In most cases, the child either will not recognize the usefulness of the safety button or, if he/she does, he/she will not be able to simultaneously press the safety button far enough to create a flame. As such, the child will most likely abandon the lighter after several unsuccessful attempts.

Once the intended operator has pressed the safety button far enough to both unlock the trigger and provide adequate fuel release, the operator then presses the trigger in order to generate a flame. However, to sustain the flame, the operator must continue to hold the safety button in its activated position. This is a significant departure from lighters that are currently in the market. In most lighters currently in use, once a flame is generated by depressing a trigger, the flame will subsist for as long as the operator continues to hold the trigger in its activated position. In contrast, in the present invention, the cam mechanism allows separation of fuel-release on the one hand, and spark generation on the other, so that spark generation will not necessarily lead to the production of a sustained flame.

It follows that, to successfully operate the present invention, the user must recognize that, once a flame has been generated, it is the safety button, and not the ignition trigger, that must be held in the activated position. This is another procedural step which creates a mental concept that is simple for the adult user to grasp and practice, but difficult for young children to either grasp or practice.

In the first preferred embodiment, once the user no longer needs the flame and the safety button is released, the return spring in the cam mechanism ensures that the cam lever, the fuel-release lever, and the safety button return to their original stationary positions, thus also automatically re-locking the trigger in the inoperable state. In the second preferred embodiment, the lever spring ensures that the fuel-release lever and the safety button all return to their original stationary positions when the safety button is released, thus also automatically re-locking the trigger in the inoperable state.

As can be understood from the above description, the invention disclosed herein achieves its safety objectives without making operation of the lighter any more cumbersome than a regular utility lighter. Specifically, the safety button is positioned in such a way that operation of the lighter is very simple in experienced hands. An adult user familiar with the operation of utility lighters still needs to use only one finger to sustain the flame. This allows the user to operate the lighter in a safe, yet non-complicated manner.

This and other advantages of the present invention will become more apparent through the following description of the drawings and detailed description of the preferred embodiment.

DETAILED DESCRIPTION OF THE PREFERRED EMBODIMENTS

Figure 1:
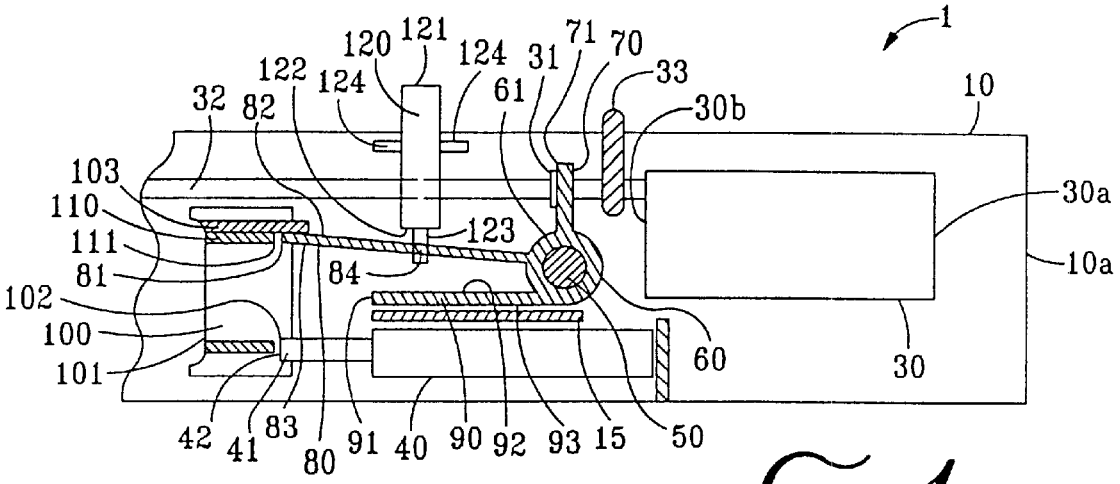
FIG. 1 is a sectional view showing an embodiment of a child-resistant utility lighter according to the first preferred embodiment.

A general description of the piezoelectric utility lighter (1) will be provided before presenting a detailed description of the improvement in the safety feature that constitutes the invention.

Generally, the elements of the utility lighter (1) include a lighter housing (10), a lighting rod attached to the forward end of the lighter housing via engagement means (not shown), a support ring which slides over the overlapping portions of the lighter housing and lighting rod (not shown), a fuel tank (30), a piezoelectric unit (40), and a trigger (100).

Figure 2:
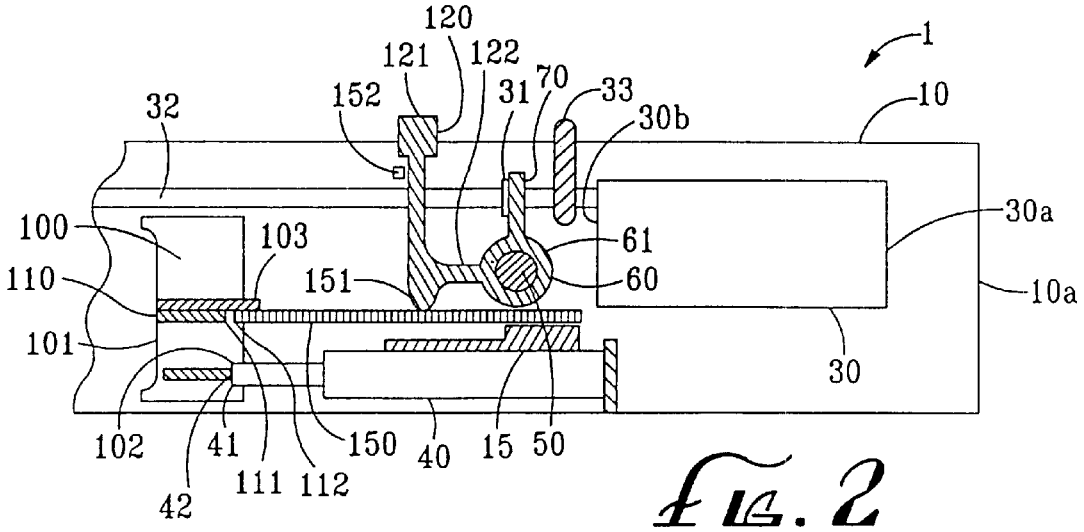
FIG. 2 is a sectional view showing an embodiment of a child-resistant utility lighter according to the second preferred embodiment.

The lighter housing (10) is comprised of two shells, cut along the longitudinal axis of the lighter (1). FIGS. 1 and 2 show one of these shells. The lighter housing (10) has a back end **(10*a*) and a forward end (not shown), where the forward end is equipped with engagement means (not shown) to engage the lighting rod (not shown). The lighting rod, which typically has a cylindrical cross section, has a free end which constitutes the tip of the lighter (1)** and an engagement end which connects to the forward end of the lighter housing. Where the forward end of the lighter housing and the engagement end of the lighting rod overlap, there is provided a support ring (not shown) which slides over and maintains the lighter housing-lighting rod combination.

The lighter (1) is equipped with a fuel tank (30) near the back end **(10*a*) of the lighter housing (10). The fuel tank (30) has a bottom portion (30*a*) facing the back end (10*a*) of the lighter housing, and a top portion (30*b*) pointing towards the forward end of the lighter housing. A fuel-release valve (31) is attached to the top portion (30*b*) of the fuel tank. This valve is spring loaded so that it is normally urged to the closed position. The valve is also provided with a gas tube (32) which extends through the lighting rod and to a discharge nozzle (not shown) at the free end of the lighting rod. The valve is opened via the operation of a fuel-release lever (70). Finally, a flame-adjusting knob (33) is provided on the valve (31)** which can be turned to adjust the amount of fuel released and, thus, the height of the resultant flame.

The next element of the lighter (1) is a piezoelectric unit (40). This unit is fitted within the top portion **(30*b*) of the fuel tank and protrudes from said top portion. The upper section of the piezoelectric unit (40) constitutes the sliding section (41). The sliding section (41) has a contact surface (42) that is in contact with an undersurface (102) of trigger (100). Operation of the piezoelectric unit (40)** creates an electric discharge that is carried to the free end of the lighting rod via a wire (not shown).

One of the primary elements of the first preferred embodiment (FIG. 1) is a cam mechanism (60). The cam mechanism has a hub (61), as well as three projections that extend in generally different directions. These projections are: a fuel release lever (70), a cam lever (80), and a return spring (90).

The hub (61) is held in place by a cam-support pin (50). The cam-support pin is a projection that extends from the inner surface of one of the lighter housing shells (10) in a direction that is perpendicular to the longitudinal axis of the lighter (1). The hub fits onto and is supported by the cam-support pin.

The fuel-release lever (70) has one end (71) that is located between the valve (31) and the flame-adjusting knob (33), and an opposing end that is integral with the hub (61) of the cam mechanism (60).

The cam lever (80) has one end that is integral with the hub (61) of the cam mechanism (60) and an opposing free end that constitutes the cam-lever edge (81). The cam lever also has an upper surface (82), a lower surface (83), and a cavity (84). The cavity (84) houses a safety-button pin (123) of a safety button (120).

The return spring (90) also has one end that is integral with the hub (61) of the cam mechanism (60) and an opposing free end (91). The return spring further consists of an upper surface (92) and a lower surface (93), where the lower surface rests on a projection (15) that is fixedly attached to the inner surface of one of the lighter housing shells (10).

The next primary element of the first preferred embodiment is the trigger (100). The trigger is slidably mounted between the two shells of the lighter housing (10). As in conventional utility lighters, the trigger is allowed to slide back and forth along the longitudinal axis of the lighter (1). The trigger has an operation section (101) that protrudes from the lighter housing (10) so as to be operated by a finger of the user. Generally, the operation section (101) has a surface that is slightly curved so as to appear concave. However, the invention described herein is amenable to different degrees of curvature for the operation section (101) of the trigger.

The trigger (100) also has an undersurface (102) that makes contact with the contact surface (42) of the sliding section (41) of the piezoelectric unit (40). In addition, the trigger (100) is integral with a trigger tab (103) and a stopper tab (110). The trigger tab (103) is a projection that makes contact with the upper surface (82) of the cam lever (80). The stopper tab (110) is typically placed underneath the trigger tab (103) and has a contact edge (111) that engages the cam lever edge (81).

The next primary element of the first preferred embodiment is a safety button (120). The safety button (120) is slidably fitted within the top surface of the lighter housing shell and has an operation section (121) that protrudes from this top surface. The safety button has a lower surface (122) that is integral with a safety-button pin (123), which pin (123) is in contact with the cam lever (80) via the cavity (84) in said cam lever. The safety button (120) is also integral with a set of flanges (124) that can make contact with the inner portion of the top surface of the lighter housing shell, thus limiting the range of motion of the safety button (120).

In the first preferred embodiment (FIG. 1), the primary elements of the safety-related invention described herein, as well as the interaction between these and the other, more conventional, elements of the utility lighter can be further defined as follows.

In the first preferred embodiment, the hub (61) of the cam mechanism (60) is fitted onto and supported by the cam-support pin (50), so that the hub (61) is capable of rotating around the cam-support pin (50). In order to operate the lighter (1), the user must press the trigger (100) to create a spark, and release fuel so that a flame can be generated. However, when the user attempts to press the trigger (100), the trigger will not move significantly or at all.

In the inoperable state, the trigger tab (103) is in contact with the upper surface (82) of the cam lever (80). The trigger (100) is integral with a stopper tab (110) whose contact edge (111) engages the cam-lever edge (81) of the cam lever (80). This acts as a locking mechanism which must be released before the trigger can be moved. To release the lock, the user must press the safety button (120) by pushing on the safety button operation section (121). When the safety button (120) is depressed, the motion of the safety button (120) is translated to the cam lever (80) via the safety-button pin (83) as resistance is provided by the return spring (90) pressing against the projection (15).

Initially, the cam lever (80) moves, so that its cam-lever edge (81) is disengaged from the contact edge (111) of the stopper tab (110). In addition, the initial pressing of the safety button (120) will cause the fuel-release lever (70) to also move slightly. However, this movement will be insufficient to release an amount of fuel that is adequate for flame production.

With the locking mechanism disengaged, the user can now press the trigger (100) in order to create a spark. As the operation section (101) of the trigger (100) is pushed, the undersurface (102) of the trigger (100) contacts the contact surface (42) of the sliding section (41) of the piezoelectric unit (40). In this way, as the trigger (100) is activated, so is the piezoelectric unit (40), so that a spark is generated when the sliding section (41) has moved back far enough.

Without more, the operational procedure described above will only produce a spark. In order to produce a flame, the operator must continue to push the safety button (120), thereby further moving the cam lever (80). This, in turn, causes further rotation of the hub (61), which causes the fuel-release lever (70) to open the fuel-release valve (31) and release fuel. Now, with the safety button (120) held in this position, depression of the trigger (100) will allow a flame to be generated.

Once a flame has been generated, it can be sustained only if fuel continues to be supplied. As explained above, this will only occur if the safety button (120) is held in position and not released after a flame has been generated. Simply holding the trigger (100) in the activated state will not sustain the flame. That is, even though, after the lighter has been unlocked, depression of the trigger (100) might cause the upper surface (82) of the cam lever (80) to be held underneath the bottom surface of the stopper tab (110), the hub (61) of the cam mechanism (60) has not rotated enough at this point for the fuel-release lever (70) to be able to move and sufficiently open the fuel-release valve (31).

Once the flame is no longer needed, the safety button (120) is released. This allows both the cam lever (80) and the fuel-release lever (70) to return to their stationary positions under the urging influence of return spring (90). Once in this position, the cam-lever edge (81) again engages the contact edge (111) of the stopper tab (110), thereby automatically re-locking the lighter. Finally, as the safety button (120) moves to its stationary position, it is stopped in that position when flanges (124) reach the inner portion of the top surface of the lighter housing shell.

In the second preferred embodiment (FIG. 2), one of the primary elements of the lighter is the cam mechanism (60). The cam mechanism (60) has a hub (61) and two projections: a fuel-release lever (70) and a safety button (120).

The cam mechanism (60) is held in place by a cam-support pin (50). The cam-support pin is a projection that extends from the inner surface of one of the lighter housing shells (10) in a direction that is perpendicular to the longitudinal axis of the lighter (1). The hub (61) of the cam mechanism (60) fits onto and is supported by the cam-support pin.

The fuel-release lever (70) has one end (71) that is located between the valve (31) and the flame-adjusting knob (33), and an opposing end that is integral with the hub (61) of the cam mechanism (60).

The safety button (120) is slidably fitted within the top surface of the lighter housing shell (10) and has an operation section (121) that protrudes from this top surface. The safety button has a safety button projection (151) that contacts the lever spring (150). The safety button has a lower portion (122) that is integral with the hub (61). A safety button stop (152) limits the downward range of motion of the safety button. The safety button stop is a projection that extends from the inner surface of one of the shells in a direction that is perpendicular to the longitudinal axis of the lighter (1).

The next primary element of the second preferred embodiment is the lever spring (150). The lever spring has one end that constitutes a lever spring edge (112) and an opposing end that is fixed to a spring projection (15) that is fixedly attached to the inner surface of one of the lighter housing shells.

The next primary element of the second preferred embodiment is the trigger (100). The trigger is slidably mounted between the two shells of the lighter housing (10). As in conventional utility lighters, the trigger is allowed to slide back and forth along the longitudinal axis of the lighter (1). The trigger has an operation section (101) that protrudes from the lighter housing so as to be operated by a finger of the user. Generally, the operation section has a surface that is slightly curved so as to appear concave. However, the invention described herein is amenable to different degrees of curvature for the operation section of the trigger.

The trigger (100) also has an undersurface (102) that makes contact with the contact surface (42) of the sliding section (41) of the piezoelectric unit (40). In addition, the trigger is integral with a trigger tab (103) and a stopper tab (110). The trigger tab is a projection that makes contact with the upper surface of the lever spring (150). The stopper tab is typically placed underneath the trigger tab and has a contact edge (111) that engages a lever spring edge (112).

In the second preferred embodiment (FIG. 2), the primary elements of the safety-related invention described herein, as well as the interaction between these and the other, more conventional, elements of the lighter can be further defined as follows:

In the second preferred embodiment, the hub (61) of the cam mechanism (60) is fitted onto and supported by the cam-support pin (50), so that the hub is capable of rotating around the cam-support pin (50). In order to operate the lighter (1), the user must press the trigger (100) to create a spark, and release fuel so that a flame can be generated. However, when the user attempts to press the trigger, the trigger will not move significantly or at all.

When the lighter is in the locked position, the trigger tab (103) is in contact with the upper surface of the lever spring (150), and the contact edge (111) of the stopper tab (110) engages the lever spring edge (112). Engagement of these edges acts as a locking mechanism which must be released before the trigger can be moved. To release the lock, the user must depress the safety button (120) by depressing the safety button operation section (121) of the safety button. When the safety button is depressed, the motion of the safety button is translated to the lever spring via the safety-button projection (152) as resistance is simultaneously provided by the flexing of the lever spring (150).

Initially, the lever spring (150) moves, so that its lever spring edge (112) is disengaged from the contact edge (111) of the stopper tab (110). In addition, the initial depression of the safety button (120) will cause the fuel-release lever (70) to also move slightly. However, this movement will be insufficient to release an amount of fuel that is adequate for flame production.

With the locking mechanism disengaged, the user can now press the trigger (100) in order to create a spark. As the operation section (101) of the trigger is pushed, the under-surface (102) contacts the contact surface (42) of the piezo-electric unit (40). In this way, as the trigger is activated, so is the piezoelectric unit, so that a spark is generated when the sliding section (41) has moved back far enough.

Without more, the operational procedure described above will only produce a spark. In order to produce a flame, the operator must continue to push the safety button (120), thereby causing further rotation of the hub (61), which causes the fuel-release lever (70) to open the fuel-release valve (31) and release fuel. The safety button stop (152) limits the distance the safety button can be depressed. Now, with the safety button (120) held in this position, depression of the trigger (100) will allow a flame to be generated.

Once a flame has been generated, it can be sustained only if fuel continues to be supplied. As explained above, this will only occur if the safety button (120) is held in the depressed position and not released after a flame has been generated. Holding the trigger (100) in the activated state alone will not sustain the flame.

Once the flame is no longer needed, the safety button (120) is released. This allows the fuel-release lever (70) to return to its stationary position under the urging influence of the lever spring (150). Once in this position, the lever spring edge (112) again engages the contact edge (111) of the stopper tab (110), thereby automatically re-locking the lighter.

I claim:

1. A utility lighter comprising a lighter housing, a lighting rod projecting from the lighter housing, a fuel tank, a valve for releasing fuel from said tank, a gas tube connected to the valve and extending through the lighting rod, an ignition unit for generating a spark, and a safety mechanism comprising:

a trigger, slidably mounted in the lighter housing, for activating the ignition unit, the trigger having a stopper tab;

a lever spring having an engaged position and a disengaged position, the lever spring being aligned with the stopper tab in the engaged position for impeding depression of the trigger; and a safety button protruding from said lighter housing and also engaging a cam mechanism within said lighter housing; said cam mechanism capable of simultaneously engaging said fuel release valve and said lever spring to permit the flow of fuel and to move said lever spring out of the engaged position with said stopper tab to permit activation of said ignition unit by said trigger thereby igniting the lighter.

2. The safety mechanism of claim 1, further comprising a safety button stop, projecting from the lighter housing, for limiting the distance the safety button can be depressed.

3. The safety mechanism of claim 1, wherein the trigger is shaped to receive a finger.

4. The safety mechanism of claim 1, wherein the lever spring is comprised of a flexible material.

5. The safety mechanism of claim 1, wherein said safety button is integral with said cam mechanism.

6. A utility lighter comprising a lighter housing, a lighting rod projecting from the lighter housing, a fuel tank, a valve for releasing fuel from said tank, a gas tube connected to the valve and extending through the lighting rod, an ignition unit for generating a spark, and a safety mechanism comprising:

a trigger, slidably mounted in the lighter housing, for activating the ignition unit, the trigger having a stopper tab;

a lever spring having an engaged position and a disengaged position, the lever spring being aligned with the stopper tab in the engaged position for impeding depression of the trigger;

a safety button capable of being placed in linear motion to engage said lever spring to move said lever spring out of interference with said trigger to permit activation of said ignition unit by said trigger;

said safety button simultaneously engaging a means for converting said linear motion into rotational motion about at least one point;

said means re-converting said rotational motion into linear motion to engage said fuel release valve to permit the flow of fuel thereby igniting the lighter.

* * * * *